US006687381B2

(12) United States Patent
Yanagawa et al.

(10) Patent No.: US 6,687,381 B2
(45) Date of Patent: Feb. 3, 2004

(54) PLANAR LOUDSPEAKER

(76) Inventors: Mayuki Yanagawa, 150 E. Angeleno Ave., #923, Burbank, CA (US) 91502; Muto Keiko, 11059 McCormick St., #4, North Hollywood, CA (US) 91601

( * ) Notice: Subject to any disclaimer, the term of this patent is extended or adjusted under 35 U.S.C. 154(b) by 0 days.

(21) Appl. No.: 10/094,340

(22) Filed: Mar. 7, 2002

(65) Prior Publication Data

US 2002/0094108 A1 Jul. 18, 2002

Related U.S. Application Data

(60) Provisional application No. 60/177,033, filed on Jan. 17, 2000.

(51) Int. Cl.[7] ..... H04R 25/00

(52) U.S. Cl. ..... 381/423; 381/386; 381/425; 381/431

(58) Field of Search ..... 381/152, 337, 381/386, 184, 186, 423, 424, 425, 431; 181/157, 160, 163, 164

(56) References Cited

U.S. PATENT DOCUMENTS 4,472,604 A * 9/1984 Nakamura et al. ..... 381/425
4,477,699 A * 10/1984 Wada et al. ..... 181/163
6,411,723 B1 * 6/2002 Lock et al. ..... 381/423

* cited by examiner

*Primary Examiner*—Huyen Le
(74) *Attorney, Agent, or Firm*—Bruce A. Jagger

(57) ABSTRACT

A planar loudspeaker is disclosed having a unique multi-layered sound resonator plate. The resonator has an upper layer and a lower layer maintained in a flat spaced-apart relationship. Divider walls or ribs are present to maintain the upper and lower layers spaced-apart, and in a self-taut state with internal chambers. The resonator layers and divider walls establish a plurality of internal passages or chambers that may or may not be sealed. The planar speaker includes a frame assembly having a mount plate and a resonator driver attached to the mount plate. The driver being responsive to an electrical signal and attached to a radiator that is movable in accordance with the movement of the driver. The flat spaced-apart resonator is attached to the radiator and frame, which produces sound when vibrated. The aspect ratio of the planar loudspeaker is preferably at least about 1.3 to 1 or greater.

8 Claims, 6 Drawing Sheets

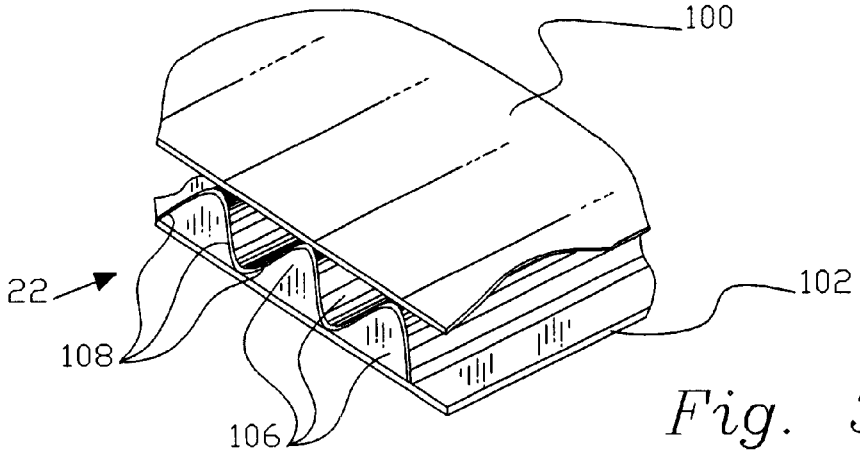
Fig. 3
Fig. 2
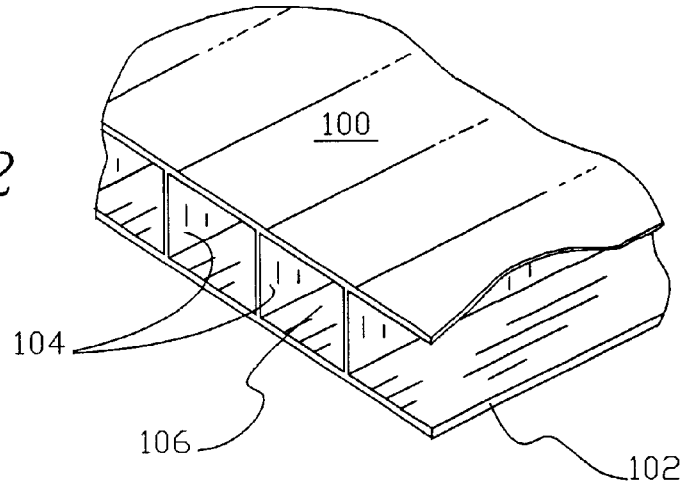
Fig. 4
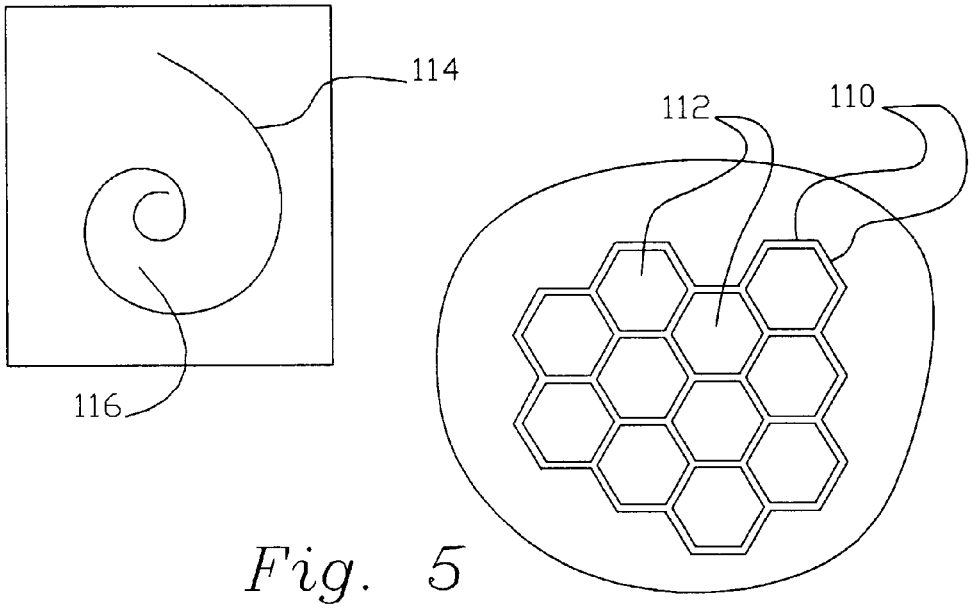
Fig. 5

PLANAR LOUDSPEAKER

This appln claims benefit of No. 60/177,033 filed Jan. 17, 2000.

BACKGROUND OF THE INVENTION

1. Field of the Invention

This invention relates to loudspeakers and, more particularly, to flat loudspeakers having a planar rectangular configuration.

Most speakers are configured with a cone shaped diaphragm attached to an electromagnetic driver assembly. However, conventional expedients have required massive speaker enclosures in order to increase the efficiency of the speaker, or to increase the quality and bandwidth of sound emitted by such speakers. Many alternative speaker designs have been proposed to reduce the size, and particularly the thickness, of speakers. Although the use of such expedients may permit a reduction in the thickness of a given speaker, they generally do not produce the same quality or output level of sound as do conventional cone speakers.

Recently there has become a need to produce inexpensive, thin compact speakers that are extremely resistant to harsh environmental conditions, and capable of producing a high output sound level over a wide bandwidth throughout the life span of the speaker. Such applications include the automotive industry, computer industry, and the like. The previous expedients in speaker development have generally been unable to meet this need.

Thus, there has been recognized a need to make more compact planar or flat type speakers for use in restricted areas, which also have the ability to produce sounds at a high output sound level over a wide bandwidth throughout the life span of the speaker.

2. Description of the Prior Art

The most common speaker driver assembly for conventional speaker utilizes a voice coil and permanent magnet attached to a cone diaphragm wherein the passage of a fluctuating electrical current through the voice coil causes the diaphragm to vibrate. As the diaphragm vibrates, airwaves are produced which are perceived as sound. Conventional voice coil drive units with conventional cone speakers are highly inefficient, converting less than about five percent of the applied electrical energy into sound energy. Attempts to improve the efficiency of these units have undesirably required massive speaker enclosures, and the like.

Large speakers have many disadvantages. For instance, the large mechanical inertia inherent in these speakers reduces the frequency range at which they can vibrate, which in turn reduces the bandwidth of sounds they can produce. Another disadvantage is that these speakers cannot be used in applications requiring installation in highly restricted and compact areas. Such applications, for example, in automobile door panels, and the like, typically require relatively flat and compact speaker configurations.

An alternative speaker driver to the voice coil assembly is the piezoelectric transducer. The piezoelectric transducer utilizes crystalline materials that mechanically vibrate when subjected to a supplied voltage. Although the piezoelectric type speaker has the ability to be used in more compact speaker configurations, the crystalline vibrations produced generally are unable to produce a practical level of sound output and wide bandwidth of reproducible sound. Hence, piezoelectric transducer speakers, by themselves, have generally been unable to achieve the high level of sound output and quality of sound reproduction required in many space-restricted applications.

Another alternative speaker drive assembly is the electrostatic driver, which uses a sheet or film as a sound radiator coupled with a flat plate or mesh. Generally, the film and plate act together as a capacitor. An audio signal is mixed with a high DC polarized voltage that is applied across the capacitor. When the high DC polarized voltage is varied in accordance with the audio signal; the electrostatic charge across the capacitor varies. As the charge varies, so too does the force between the plates, which in turn causes the film to vibrate. However, the electrostatic driver requires an expensive DC voltage source and transformer to operate, which, in turn, increases the production cost and size of the speaker. Hence, electrostatic speakers are inherently both costly and bulky and are generally unacceptable not only for general applications, but even more so in space-restricted applications.

One relatively compact flat speaker expedient utilizes a solid panel as a sound resonator driven by a direct connection to either a conventional voice coil or piezoelectric driver. However, it is difficult for the solid panel resonator to produce a wide sound bandwidth unless its vibration characteristics conform to a complex bending behavior. In order to configure the rigid panel to respond accordingly, the panel must be precisely manufactured and assembled to exacting tolerances. This is not only time consuming but costly, and is highly undesirable in speaker design. Thus, the use of the rigid panel flat speaker is unacceptable in space-restricted applications.

Another prior flat speaker design utilizes a single thin sheet or film membrane that is pre-stressed in tension within a frame. The single thin sheet functions as a sound resonator. Although the thin membrane eliminates the expense of the rigid panel diaphragm, it too has its drawbacks. For instance, it is difficult to obtain the proper pre-stress during assembly. In addition, the pre-stress must remain essentially constant throughout the life span of the speaker in order to produce quality audio performance over time. Maintaining this pre-stress is difficult, as aging and thermal effects on the film membrane tend to substantially reduce the amount of pre-stress over time. Another drawback with the thin membrane speaker is that it is highly vulnerable to physical damage such as punctures that can significantly reduce the sound quality of the speaker. Thus, the thin film membrane flat speaker, although useable in space restricted applications, does not satisfactorily produce high quality sound output consistently and repeatably over the life span of the speaker.

Previously proposed expedients include, for example, Yokoyama U.S. Pat. No. 5,009,281. Yokoyama proposes several embodiments of acoustic apparatus where the diaphragm of a vibrator radiates directly and also drives a resonator. The disclosed resonators are in the form of chambers, not flat panels. Yokoyama also includes a catalog like listing of prior art transducers. Polk U.S. Pat. No. 4,903,300 discloses a flat speaker for use within wall cavities, but uses the entire volume of the wall space to get the desired output. Kumada et al. U.S. Pat. No. 4,352,961 discloses a flat speaker where a piezoelectric driver is used in a watch. The driver is mounted to the transparent face of the watch, which is used as the resonator. Another thin profile audio device with a piezoelectric driver is shown in Kumada U.S. Pat. No. 4,471,258. Skaggs U.S. Pat. No. 4,714,133 discloses a speaker structure where a conventional cone speaker is acoustically coupled to a radiator. Kasai et al. U.S. Pat. No. 4,551,849 discloses a thin automotive audio system uses a vehicle panel that is directly driven by a driver. Yanagishima et al. U.S. Pat. No. 4,514,599 likewise discloses an automotive vehicle audio system in which a vehicle panel is driven by a driver of the speaker. Watters et al. U.S. Pat. No. 3,347,335 proposes the use of a honeycomb core sandwiched between two stiff sheets as a flat acoustic radiator. Matsuda et al. U.S. Pat. No. 4,122,314 discloses a loudspeaker with a plane vibrating diaphragm where the diaphragm is in the form of a sandwich structure. Guenther et al. U.S. Pat. No. 6,097,829 discloses a flat-Plane diaphragm fabricated using sandwich construction. Barlow U.S. Pat. No. 3,111,187 likewise discloses a flat panel diaphragm fabricated using sandwich construction. Pearson U.S. Pat. No. 3,861,495 discloses a loudspeaker in which a cone speaker is acoustically coupled through telescoping frusto-conical members to a flat vibrating panel. Murase U.S. Pat. No. 3,674,109 discloses a thermoplastic laminated vibration plate for a loudspeaker, which includes a centrally located cone portion and a flat portion surrounding the cone portion. The cone portion is only a fraction of the whole diaphragm area. Matsuda et al. U.S. Pat. No. 4,252,211 discloses a loudspeaker with a flat plate diaphragm that is driven by a plurality of spaced apart magnetic drivers. Matsuda et al. U.S. Pat. No. 4,198,550 discloses a flat panel sandwich diaphragm in which the edges are reinforced.

It is, therefore, desirable to develop a compact, planar speaker that consistently and repeatably emits high quality sound over a wide bandwidth throughout the entire life span of the speaker. It is also desirable to develop such a speaker whose sound characteristics are substantially unaffected by changes in temperature, moisture, radiation, and the like. It is also desirable to create such a speaker that is inexpensive to produce and is resistant to the effects of aging. It is also desirable to develop such a speaker that is resistant to sound degradation due to physical damage such as punctures and the like. These and other difficulties of the prior art have been overcome according to the present invention.

BRIEF SUMMARY OF THE INVENTION

It is an object of the present invention to provide a thin, planar speaker that emits a high quality sound output level over a wide bandwidth for the life span of the speaker. It is also an object of the present invention to provide a speaker that can maintain high quality sound reproduction in spite of exposure to environmental changes in temperature, moisture, radiation, and the like, and to the effects of aging that can degrade the performance of the speaker.

It is another object of the present invention to minimize manufacturing costs by providing a planar speaker that is inexpensive to manufacture.

It is yet another object of the present invention to produce a planar speaker that is significantly more resistant to physical damage such as punctures than conventional single wall speaker diaphragms.

A unique flat speaker is disclosed having a flat spaced-apart layered resonator attached to a driver through an outwardly flared radiator. The unique resonator fundamentally comprises a multi-layered structure having an upper layer and a lower layer. The layers are maintained in a spaced-apart relationship by divider walls positioned therebetween. The divider walls and the respective layers define chambers or internal passages within the resonator. The resonator maintains a self-taut state, and the divider walls can be arranged into numerous configurations. In a preferred embodiment the divider walls are arranged in a spaced apart, linear, and parallel relationship, which forms internal passages within the resonator. This configuration also forms open ends of the internal passages at the periphery of the resonator. The resonators can be formed, for example, by extrusion or lay-up procedures. Extrusion procedures where the resonator is fully formed at the moment of extrusion are generally the least expensive of the available resonator formation procedures. Lay-up procedures lend themselves to the formation of resonators with, for example, corrugated, sinuous, or spiral divider walls. In still other embodiments the internal passages defined by the divider walls form individual cells. These cells, defined by the divider walls, can be configured into numerous shapes such as a circle, square, trapezoid, triangle, hexagon, octagon, or the like. In one embodiment the individual cells are shaped in a honeycomb configuration.

The unique resonator of the present invention can be made from many materials such as polymers, metal foils, and cellulose based materials. One or more materials can be used in one resonator, if desired. The flat panel resonator may also be made from homogeneous or heterogeneous composite materials having uniform or non-uniform densities, characteristics, or dimensions along the resonator panel in any direction, or between the layers, or among the divider walls. In a preferred embodiment, the resonator is made by extrusion from a polyimide thermoplastic material. The open ends of the internal passages of the resonator may or may not be sealed at the periphery of the resonator. The sound characteristics of the loudspeaker can be manipulated by, for example, sealing, not sealing, or partially sealing these open ends.

The flat speaker also includes a frame assembly, a mount plate having a plurality of sound relief openings, a driver attached to the mount plate, and a tapered radiator construct having neck and mouth regions with different areas. The resonator is attached at its periphery to the frame assembly and to the mouth portion of the radiator. The mouth portion of the radiator may be attached to either the upper or lower layer of the resonator, as desired. However, a hole must be provided in the resonator when it is attached at its upper layer to the radiator. The neck portion of the radiator is connected to the driver. Although the construction of the resonator is such that the resonator maintains a generally self-taut state, a means for tensionally attaching the resonator to the frame can be used, if desired. Such tensionally attachment means can, for example, take the form of tensor rods. The radiator vibrates responsive to the vibration of the driver. The radiator, in turn, causes the resonator to vibrate. The radiator is preferably a three dimensional tapered object in the form of a right circular shell with the surface of the shell being defined as a surface of revolution about an axis of revolution. The radiator can be configured into various shapes, such as frusto-conical, parabolic, bell, or the like. Preferably, the radiator is attached slightly off from the geometric center of the resonator in order to eliminate the cancellation of sound waves propagating across the resonator.

The flat speaker described herein produces significant improvements in sound quality and volume output, and durability compared to conventional flat speakers.

BRIEF DESCRIPTION OF THE DRAWINGS

Referring particularly to the drawings for the purposes of illustration and not limitation:

FIG. 2 is a partially cut isometric view of an embodiment of a planar speaker resonator;

FIG. 3 is a partially cut isometric view of another embodiment of a planar speaker resonator;

FIG. 4 is a partially exploded top view of another embodiment of a planar speaker resonator;

FIG. 5 is a partially exploded top view of another embodiment of a planar speaker resonator;

DETAILED DESCRIPTION OF THE PREFERRED EMBODIMENTS

Figure 1:
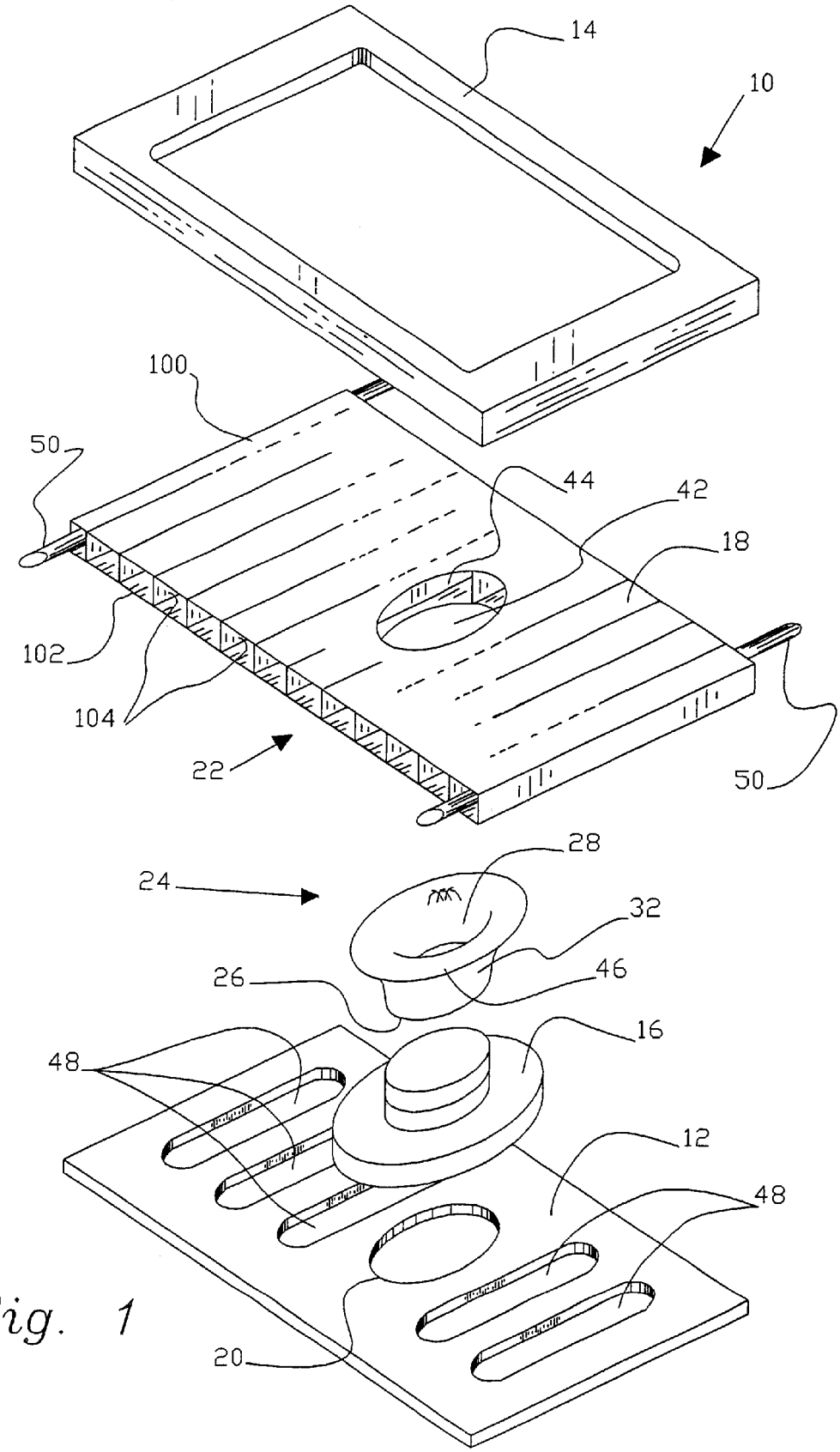
FIG. 1 is an exploded isometric view of an embodiment of the planar speaker of the present invention.

Referring particularly to the drawings, there is illustrated generally at 10 a flat speaker having a mount plate 12, a frame 14, a driver 16, a radiator indicated generally at 24, and a resonator 18. The frame assembly or structural support for the speaker is provided by the mount plate 12 and the frame 14, which can be made from nearly any rigid material such as steel, wood, plastic, ceramic, and the like. The mount plate serves to structurally support a resonator driver 16. Generally, the frame and the mount plate are secured together to define the form of the flat speaker.

The resonator driver 16 of the present invention can be of the conventional voice coil electromagnetic type, the piezoelectric type, or the like, as desired. Because it is desirable to minimize the overall thickness of the flat speaker, the mount plate is provided with an opening 20 in which the resonator driver is placed such that the bottom of the resonator driver is aligned with the bottom of the mount plate 12.

The frame 14 preferably has the same shape as the mount plate 12, although other shapes can be used, if desired. In the embodiment chosen for illustration, the mount plate 12 is attached to the frame 14. In the embodiment shown in FIG. 1, the frame is rectangular, solid around the edges, and open in the center. The frame 14, or overall shape of the speaker, for aesthetic purposes can have any desired shape, such as circular, elliptical, trapezoidal, hexagonal, star-shaped, or the like. The resonator, however, should be asymmetrically rectangular, that is it should be in the form of a rectangle that is not square.

The resonator driver 16 vibrates in response to an alternating current signal, which vibrates the multi-layer resonator 18 through a tapered radiator. If used with a piezoelectric driver assembly, the crystalline material will vibrate in response to an applied voltage, which, being attached to the resonator through a tapered radiator, causes the resonator to vibrate.

Of significance to the present invention is the configuration of the multi-layer resonator. The resonator 18 is unique in that it is configured in a layered or sandwich structure having an upper layer 100 and lower layer 102 spaced-apart by divider walls 104 affixed between the two layers. This type of configuration is herein defined as being self-taut; that is, the structure is self-supportive and maintains a generally planar shape in an unassembled state, that is, prior to being secured to the frame of the speaker. This configuration eliminates the need for additional cross members to support the resonator 18.

The layers of the resonator are preferably made of a thin flexible material that is durable enough to endure the vibration forces of the resonator driver 16, and yet stiff enough to vibrate in response to the resonator driver 16. Any thin material having a generally self-taut structure could be used so long that it is stiff enough to emanate sound waves while being strong enough to survive harsh environmental conditions. Such adverse environmental conditions include extreme heat and cold cycles, and varying humidity. Such conditions are frequently encountered in automotive applications. Materials that are highly resistant to water absorption, or treated to be so, are desirable. In the embodiments shown, a polyimide material is used as it not only meets the above requirements, but also because it is a relatively inexpensive material. The polyimide material used in the resonator structure is an especially desirable material because it is strong enough to endure physical constraints, and because it is also resistant to chemical and environmental corrosion. Many alternative polymer materials may be used, if desired, for example, such as nylon, polypropylene, polyethylene, polyester, polycarbonate, polystyrene, polyurethane, polyvinyl chloride, polyvinyl fluoride, and the like. Also, any number of cellulose-based materials may be used, if desired, such as fibrous paper, and the like. In addition, metal-foil materials could be used, if desired, such as aluminum foil, tin foil, and the like.

The resonator 18 can also be composed of homogeneous or heterogeneous composite materials as well. In addition, some portions of the resonator may be heavier than other portions, such as by the use of different materials having varying densities, or the like. Heterogeneous composite configurations may achieve greater sound bandwidth characteristics, but at additional manufacturing costs. Other materials and composites thereof, can be used, so long as the final structure maintains a self-taut state. Generally, the self-taut state of the resonator helps enable the speaker to maintain quality sound reproduction throughout the life span of the speaker.

It is believed that the multi-layered resonator provides significant advantages over the prior art single-membrane diaphragms. For example, adding the additional layer to the resonator provides additional protection against aging or radiation damage compared to single membrane diaphragms. Furthermore, the self-taut nature of the resonator more readily achieves a consistent tensile structure on which vibration patterns can more readily be replicated over the life span of the speaker, resulting in more consistent and repeatable sound characteristics. In addition, the multi-layered structure provides additional protection against physical abuse induced by inadvertent contact, and the like, which can result in punctures. Due to the multi-layered structure, the substantial sound deterioration effects due to punctures, are substantially reduced as compared to conventional single membrane speaker diaphragms.

The peripheral edges, indicated generally at 22, of the resonator 18, according to one embodiment, are securely attached to the frame 14 in order to maintain the resonator in a flat, self-tensioned condition. In one embodiment the passages within the resonator are sealed at the peripheral edges 22 when connected to the frame 14, thereby establishing sealed internal passages. This has been found under certain circumstances to improve the sound quality of the speaker and provide additional protection from fluctuating environmental conditions such as humidity changes, and the like. Alternatively, it has been found that in unsymmetrical embodiments, the quality of the lower frequency sounds is substantially improved if the longer peripheral edges of the resonator are not attached to the frame. For example, in a rectangular embodiment where the resonator 18 is five inches by three inches, the sides that are five inches long are preferably not attached to the frame. In general, the quality of the sound is improved in that leaving these longer sides open extends at least the lower end of the range of sound, which is generated by the resonator. Lower frequencies are thus produced. A preferred form of the resonator is that wherein internal ribs are formed by linearly extending walls that serve to define narrow elongated chambers within the resonator. Preferably, in this form of elongated rectangular resonator, the internal ribs or walls extend parallel to one peripheral edge. Mounting the rectangular resonator in the frame so that it is only attached at its four corners, plus one point on a peripheral edge of the resonator that extends generally transverse to the ribs, generally produces a very desirable sound response. More partial attachments at local spots, or even fully attaching the sides of the resonator that extend transverse to the ribs generally reduces the maximum decibel level that the resonator is capable of generating. The provision of more attachment points between the frame and the resonator increases the stability of the mounting, and may be preferred where shock and vibration are anticipated to be experienced in use.

The coupling of the resonator 18 with the driver 16 is achieved by the inclusion of the radiator 24. The radiator has been found to improve the sound radiation capability of the speaker. The radiator 24 is attached at one end to the resonator driver 16 and at the other end to the resonator 18. Desirably, the radiator 24 has been found to amplify the vibration from the driver to the resonator.

Figure 6:
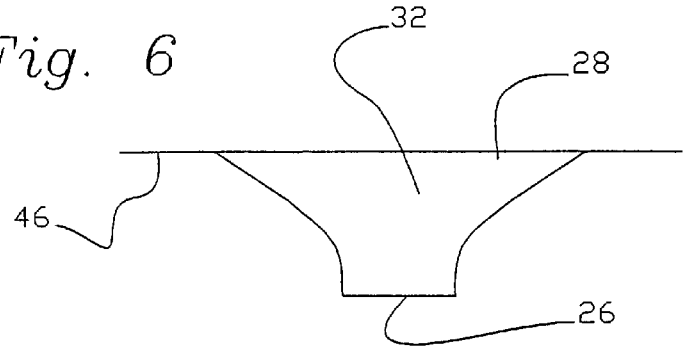
FIG. 6 is a side view of a bell shaped radiator utilized in an embodiment of the present invention.
Figure 7:
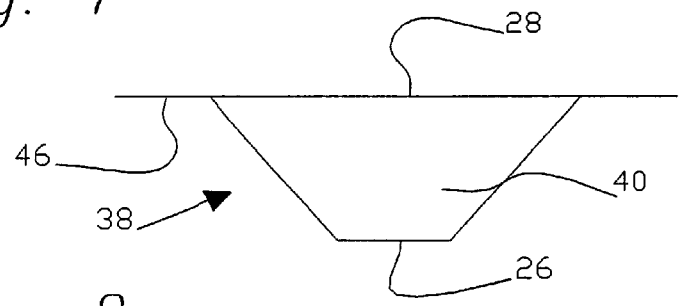
FIG. 7 is a side view of a frustoconical shaped radiator utilized in an embodiment of the present invention.
Figure 8:
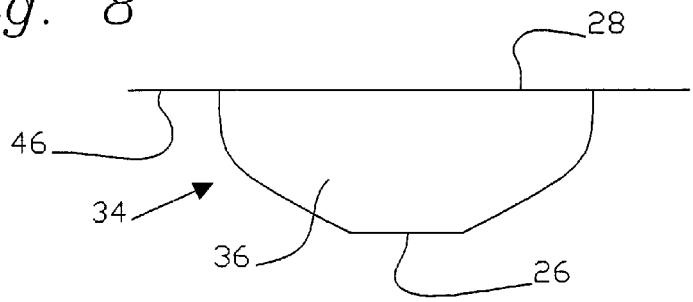
FIG. 8 is a side view of a parabolic shaped radiator utilized in an embodiment of the present invention.

A neck portion 26 of the radiator 24 is preferably attached to the driver 16 while the mouth portion 28 is attached to the resonator 18. The vibrations from the driver 16 are transmitted through the radiator 24 and to the resonator 18. It has been found that the frequency response characteristics of the loudspeaker can be altered by changing the shape, thickness, or construction material of the radiators. For instance, both FIG. 1 and FIG. 6 depict a bell-shaped radiator having a neck portion 26, a mouth portion 28, and a surface 32 that increases in circumference and flares out between the neck portion 26 and the mouth portion 28. FIG. 8 depicts an alternative parabolic radiator, indicated generally at 34, having a neck portion 26, a mouth portion 28 and a surface 36 that forms a convex parabolic shape between the neck portion 26 and the mouth portion 28. FIG. 7 depicts another alternative radiator, indicated generally at 38, having a frustoconical shape. The radiator 38 has a neck portion 26, a mouth portion 28, and a surface 40 that forms a straight cross-sectional surface between the neck portion 26 and the mouth portion 28. The shapes of the radiator shown are only examples, and many other shapes can be used, if desired. For instance, the shape of the radiator can be fine-tuned in order to achieve a desired frequency response for the loudspeaker.

Figure 9:
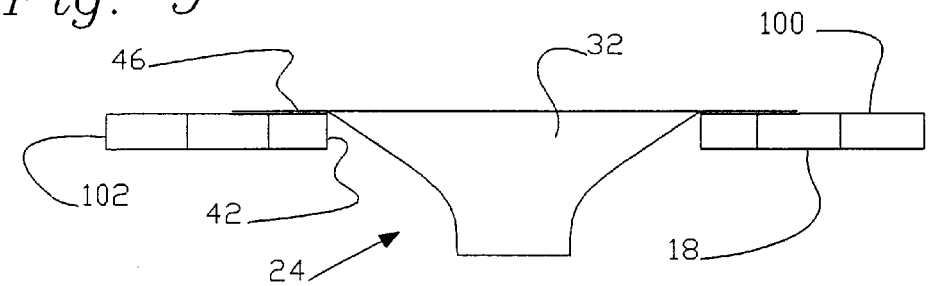
FIG. 9 is a side view of an embodiment of the present invention showing the connection of the radiator to the upper layer of the resonator.
Figure 10:
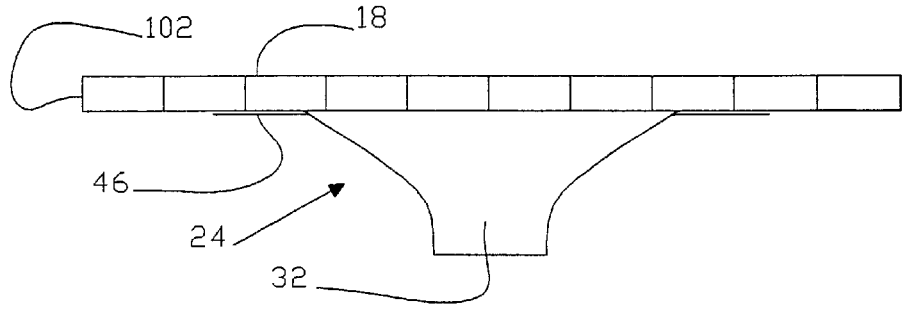
FIG. 10 is a side view of an embodiment of the present invention showing the connection of the radiator to the lower layer of the resonator.

FIG. 9 depicts one configuration wherein the rim 46 of radiator 24 is attached to the resonator 18 at upper layer 100. In this configuration (which is also shown in FIG. 1), a hole 42 is provided in the resonator to allow for the insertion of the radiator 24. An alternative configuration is shown FIG. 10 where the rim 46 of radiator 24 is attached on the bottom of the resonator 18 at lower layer 102. In this configuration a hole is not needed in the resonator but may be provided, if desired. In general, such a hole should be provided if better sound quality is desired. Attaching the radiator to the resonator can be accomplished by many well-known means in the art, such as by application of a bonding material, ultrasonic bonding, or the like. Suitable bonding materials include, for example, epoxy based bonding materials, and the like. Ultrasonic bonding has been found to be satisfactory and particularly inexpensive where the nature of the materials permits its use. Typically, thermoplastic materials are most suitable for joining with ultrasonic welding. The connection to the upper layer has the advantage of making the planar speaker thinner, while the connection to the lower layer has the advantage of making the planar speaker easier to assemble. Either configuration may be used, as desired.

It has been found that the provision of hole 42 drastically improves the medium and high frequency sound emissions of the resonator 18 by establishing a clear path for the movement of air across the radiator and resonator. Preferably the hole 42 is about the same size as the mouth portion 28 of the radiator 24, and the radiator is attached to either the upper or lower layer of the resonator. In general, the circumference 44 of the hole 42, at either the upper or lower layer, is bonded to the rim 46 of the radiator 24. If desired, all internal passages within the layered resonator exposed at circumference 44 of the hole may be sealed to protect the resonator against fluctuating environmental conditions. Leaving one or more of the internal passages open generally improves the sound quality. Leaving the sides unattached to the frame generally further improves the sound quality.

Tensionally pre-stressing the resonator can further enhance the sound quality of the speaker. Pre-stressing the resonator can be accomplished by placing the resonator in tension when installing it to the frame. This can be accomplished, for example, by installing pre-stress retainers 50 through the resonator at opposed ends, as shown in FIG. 1. These retainers, once engaged in their respective mounting locations within the frame, induce a tensile pre-stress in the resonator. The mounting locations in the frame can be sized to achieve any desired pre-stress in the resonator. Alternatively, other pre-stress configurations known in the art may be used, as desired, to increase the tension of the resonator and improve the sound quality of the speaker.

There are numerous methods available for attaching the resonator 18 to the frame. For example, one inexpensive expedient is to use a commercially available adhesive such as, for example, epoxy glue, and the like. If desired, such an adhesive may be used to seal one or more of the exposed ends of the internal passages at the edges of the resonator in addition to bonding the resonator to the frame 14.

Although any adhesive bonding materials may be used, it is important that the bonding material does not contain solvents that could adversely attack the material of the resonator, and that the material, once cured, is able to withstand the cyclic vibration forces incurred throughout the life of the speaker. Solvent bonding, if carefully controlled can be used, but it is not preferred. Alternatively, the use of an adhesive may be eliminated, if desired, by mechanically attaching the resonator to the frame. Such methods are well known in the art, and include, for example, press fits, retainer rings, and the like. If desired, the resonator may be held in place, but not rigidly attached to the frame. The damping effect of the mounting is thus minimized.

It is important to the present invention that the resonator be layered in a flat spaced-apart manner. Generally this requires there be some sort of retaining means to maintain the upper and lower layer of the resonator fixedly spaced-apart. As shown in FIG. 2, divider walls 104 maintain upper layer 100 and lower layer 102 spaced-apart, thereby establishing internal passages generally shown at 106. There are nearly an infinite number of divider wall configurations that may be used, if desired. As shown in FIG. 3, the upper layer 100 and the lower layer 102 are maintained in a flat spaced-apart relationship by divider walls 108 configured in a corrugated manner. In the configurations shown in both FIGS. 2 and 3, the internal passages established by the divider walls run the entire length of the resonator from one end to the other, that is, to opposed ends on the periphery of the resonator. Other configuration may be used, if desired. For instance, as shown in FIG. 5, the divider walls 110 can be configured in a hexagonal, or honeycomb pattern, in order to maintain the upper and lower layers spaced-apart in a flat manner. In this configuration, the internal passages form individual cells, generally shown at 112. Still yet another configuration is shown in FIG. 4, wherein a single divider wall 114 is shaped in a spiral or swirl pattern, thereby creating one wound internal passage, generally shown at 116, extending within the resonator. According to the present invention, the divider walls can be modified into numerous configurations other than honeycomb, corrugate, swirl, or the like, as long as the upper and lower layers are maintained in a flat spaced-apart relationship. It is believed that the divider walls further enable the resonator to maintain the desired self-taut state.

It is well understood in the art that resonator stiffness should be maximized and weight minimized. According to the present invention, most of the volume of the resonator should be empty of structure. Preferably, the ratio of the void volume to the total volume of the resonator should be from about 0.95–0.6 to 1, and more preferably, from about 0.85–0.7 to 1.

The frame assembly includes not only the peripheral frame 14, but also the mount plate 12 in which the driver assembly is mounted. Preferably, a plurality of openings or sound relief outlets 48 are disposed in the mount plate 12 in order to improve sound clarity. These openings 48 prevent air from being trapped between the mount plate 12 and the resonator 18 at the back of the speaker. Without these openings the trapped air would undesirably have a dampening effect on the speaker. Optimally, the number, and/or size of the openings, should be as great as possible so long as the structural integrity of the mount plate is maintained. Thus, it is preferred that the mount plate structure be minimized.

As seen in FIG. 1, it is preferred to position the radiator 24 slightly off-center of the resonator 18. It is believed this off-center configuration eliminates the undesirable audio damping effects that can occur when sound waves propagating from the radiator to the frame, and back to the radiator, are cancelled. Thus, it is believed the offset minimizes this undesirable damping effect and helps to optimize the sound quality of the speaker.

Figure 11:
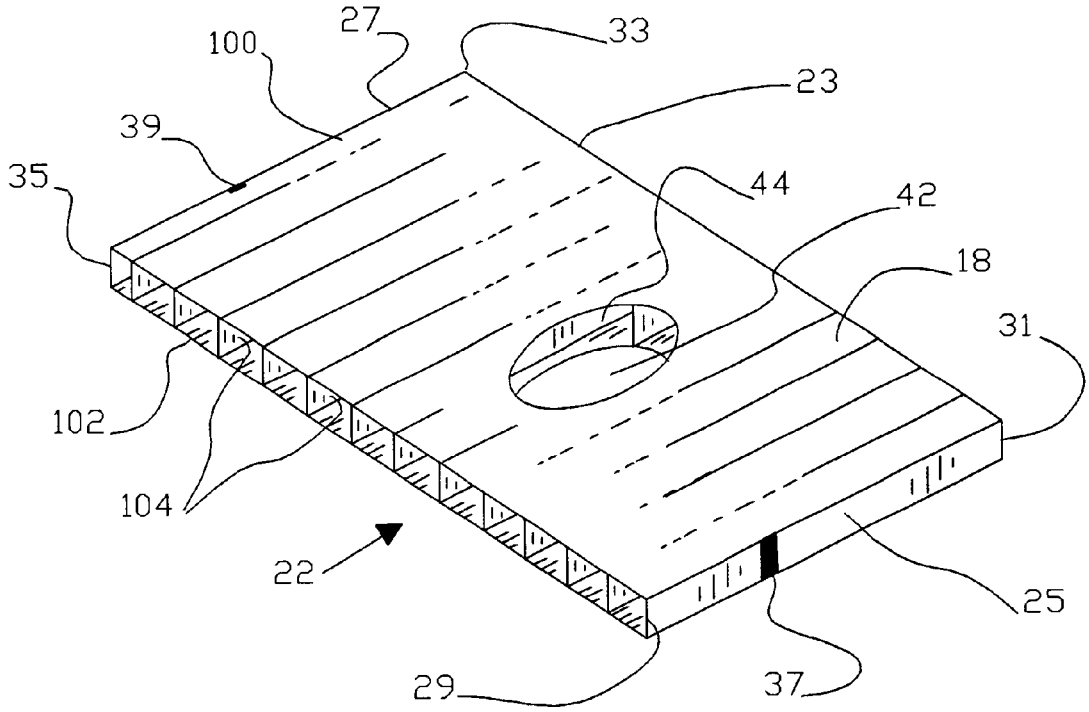
FIG. 11 is an isometric view of the resonator of FIG. 1.

With particular reference to FIG. 11, the edges and corners of the resonator illustrated there have been identified for purposes of describing the attachment of the resonator to the associated frame. The ribs 104 in resonator 18 extend parallel to one another and to edges 25 and 27. The ribs extend generally normal to edge 23 and the corresponding opposed edge, which is not numbered. In general, the most desirable sound characteristics are generated by resonator 18 when it is attached to the supporting frame only at corners 29, 31, 33 and 35, and at one point 37 on the periphery of the resonator. Preferably, point 37 is asymmetrically positioned, that is, it is positioned along the edge of the resonator between corner 31 and the mid-point of the peripheral edge 25. For additional stability, but at the expense of slightly degraded sound quality, a second asymmetrically positioned attachment point 39 can be provided on the opposed peripheral edge 27. Preferably, the asymmetrically positioned attachment points are on opposed edges, and they are on the shorter opposed edges of an asymmetrical rectangular resonator. That is, the rectangular resonator does not define a square. Also, the ends of the elongated chambers formed by ribs 104, and upper and lower layers 100 and 102, respectively, are preferably left open, unless environmental considerations dictate otherwise.

Figure 12:
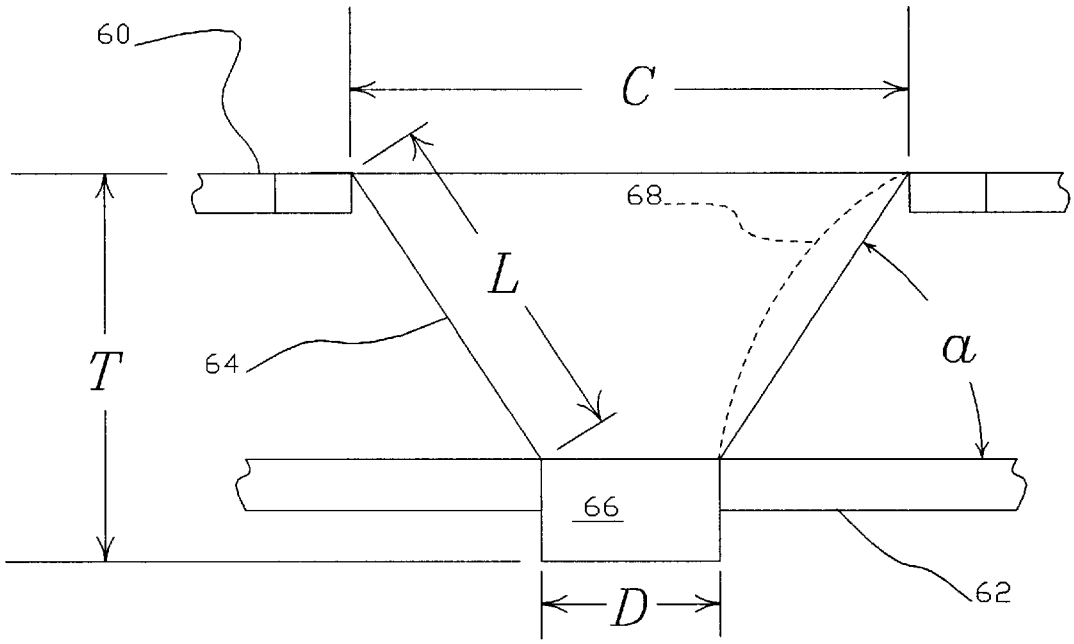
FIG. 12 is a diagrammatic cross-sectional side view of a speaker according to the present invention illustrating certain dimensions and proportions.
Figure 13:
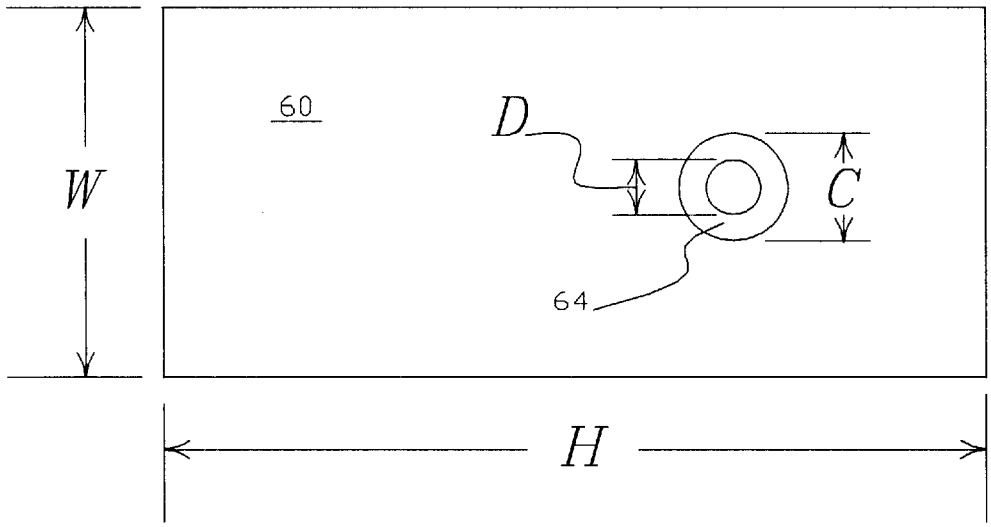
FIG. 13 is a plan view of the embodiment of FIG. 12.

With particular reference to FIGS. 12 and 13, various dimensions of the resonator-radiator assembly are illustrated. A resonator 60 is mounted to the lip of a right circular frusto-conical radiator. The nominal wall of the radiator is illustrated at 64, and an alternative wall configuration is illustrated at 68. A speaker driver 66 is mounted to mounting structure 62. The diameter of the small end of the radiator is indicated at D, and the diameter of the large end is indicated at C. The distance between the ends of the diameters C and D is indicated as length L. Nominal wall 64, for purposes of description, forms a straight line between the end points of the two diameters, C and D, even though the actual wall can take some other form, such as, for example, that shown at 68. Length L is always measured as the straight-line distance between diameters C and D. The thickness of the resonator-radiator assembly from the outer surface of resonator 60 to the rear surface of driver 66 is indicated at T. The acute angle at which the wall of radiator 64 extends, relative to a plane parallel to the plane of the resonator 60, is illustrated at angle a. As illustrated particularly in FIG. 13, the width of the rectangular resonator 60 is indicated at W, and the height of resonator 60 is indicated at H.

It has been found, according to the present invention that certain dimensions and proportions are preferred. Without regard to the size of the resonator it has been found that for resonator-radiator assemblies that have greater than 1 watt output length L of the radiator is preferably from about 5 to 20 millimeters, major diameter C of the radiator is preferably greater than about 15 millimeters, the thickness of the resonator panel is preferably from about one-sixteenth to one-quarter inches, and angle a of the radiator is preferably from about 30 to 60 degrees. Major diameter C is greater than minor diameter D, and the radiator has a right generally circular shape. The width W of the resonator is preferably at least about three times the major diameter C of the radiator. The thickness T of the resonator-radiator assembly, including the driver, is proportional to the width W of the resonator. Preferably, the proportion of T to W for the resonator-radiator assembly is in the range of from about 0.3–0.005 to 1. The aspect ratio of the resonator (height H to width W) is generally from about 1.2–10 to 1, and preferably from about 1.3–2.0 to 1.

Figure 14:
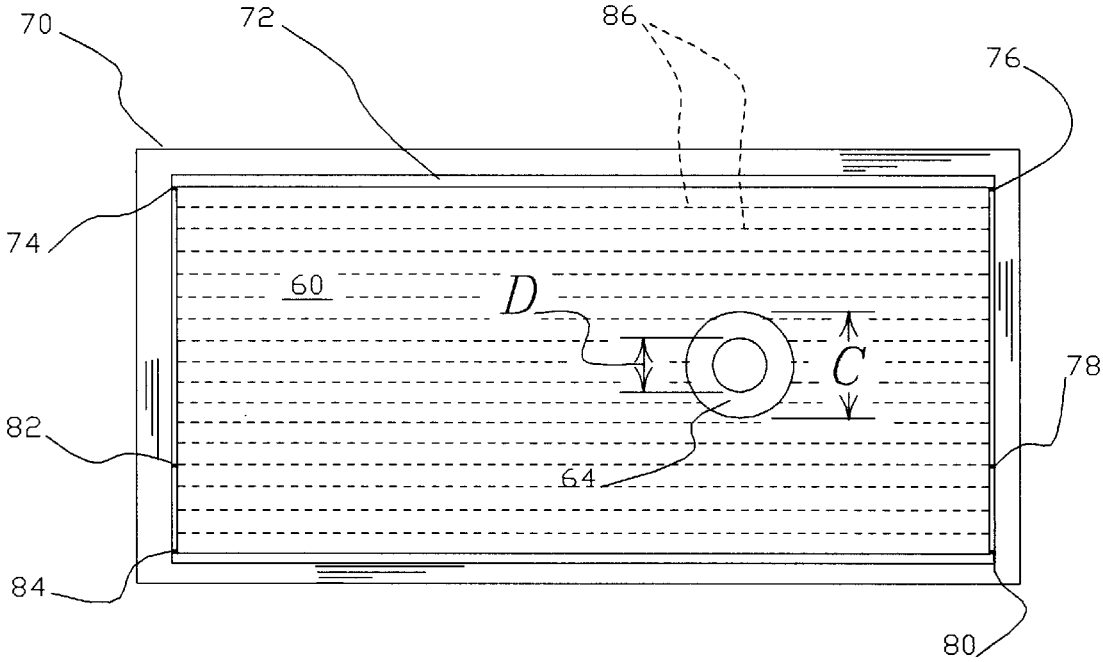
FIG. 14 is a plan view similar to FIG. 13 illustrating more of the structure.

FIG. 14 diagrammatically illustrates the mounting of resonator 60 in frame 70. The longitudinally extending internal walls or ribs within the resonator 60 are indicated at 86. Walls 86 run generally parallel to the longer side of the resonator 60. The longer edges of the resonator 60 are spaced from and unattached to the frame 70 as indicated at 72. The four corners of the resonator 60 are attached to rigid frame 70 as indicated at 74, 76, 80 and 84. Fifth and sixth attachment points 78 and 82 are shown. Preferably, attachment points 78 and 82 are offset from the mid-line of the resonator 60. Also, the attachment points 78 and 82 are preferably offset by the same amount on the same side of the mid-line so that they are generally aligned with the same internal rib of resonator 60. The radiator is asymmetrically positioned in resonator 60. Resonator 60 is asymmetrical in that it is not square.

Figure 15:
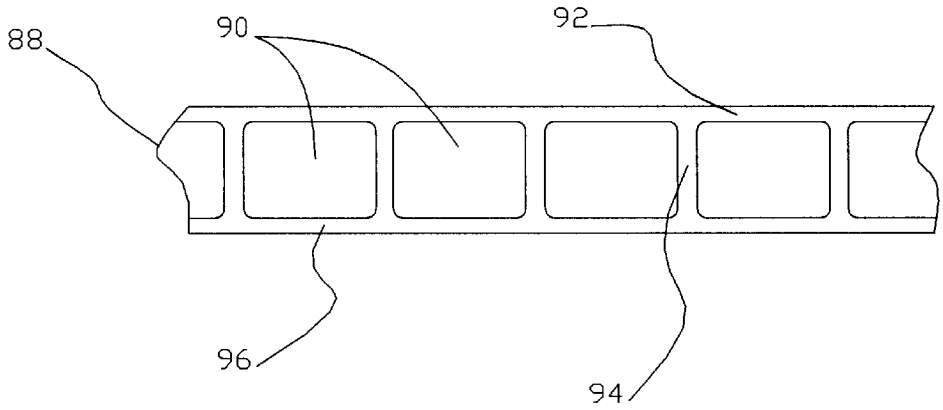
FIG. 15 is an end view of an extruded embodiment of a resonator according to the present invention.

FIG. 14 illustrates an end view of the resonator as it would appear, for example, between attachment points 78 and 80. In the embodiment illustrated in FIG. 15, the resonator 88 has been formed by extrusion. The chambers 90 extend the full length of the resonator 88. Top wall 92 and bottom wall 96 are spaced apart by internal walls 94. Preferably, the chambers 90 have a cross-sectional proportioning such that the walls formed by the top and bottom walls 92 and 96, respectively, are from 1 to 3 times the length of the internal walls 94. In a preferred embodiment, the walls are all approximately 0.2 millimeters thick, the resonator 88 is about 0.125 inches thick and the chambers 90 are proportioned so in cross-section they are about twice as long as they are wide. The resonator in this preferred embodiment is approximately 80 percent void.

What have been described are preferred embodiments in which modifications and changes may be made without departing from the spirit and scope of the accompanying claims.

What is claimed is:

1. A flat speaker having a width, a height and a thickness, said flat speaker comprising:

a resonator panel having a generally flat, asymmetrical, rectangular form, said resonator panel having four corners, two generally opposed short peripheral edges, and two generally opposed long peripheral edges, said long peripheral edges being longer than said short peripheral edges by a ratio of at least about 1.3 to 1, at least an upper layer element and a lower layer element spaced apart by rib members to define chambers between said upper and lower elements, said resonator panel being mounted in a supporting frame;

a radiator construct having a sheet of material generally shaped to conform to a surface of revolution thereby defining a right three-dimensional tapered form, said three-dimensional tapered form having an axis of revolution, an open resonator end having a first diameter, and an axially opposed open driver end having a second diameter, said first diameter being larger than said second diameter, said resonator end being rigidly mounted to said resonator panel, a said short peripheral edge being at least about 3 times said first diameter;

a driver member, said driver member having a nominal diameter and being adapted to vibrate in the audible frequency range responsive to electrical signals, said driver end being mounted to said driver member for vibration therewith, said radiator construct having a length extending between said resonator and driver ends, said length being from about 5 to 20 millimeters, said driver member being mounted on a supporting member, said radiator, driver and resonator being assembled into a resonator-radiator assembly having a thickness, said thickness being proportioned to a said short peripheral side in the ratio of from about 0.3–0.005 to 1.

2. A flat speaker of claim 1 wherein said radiator extends at an angle of from about 30 to 60 degrees to a plane that is parallel to said resonator.

3. A flat speaker of claim 1 wherein said chambers are arrayed in a spiral of generally varying cross-section.

4. A flat speaker of claim 1 wherein said chambers comprise generally linear channels arrayed generally parallel to said long peripheral edges.

5. A flat speaker of claim 1 wherein said chambers comprise generally linear channels arrayed generally parallel to said long peripheral edges, said resonator panel being mounted to said supporting frame at about said four corners.

6. A flat speaker of claim 1 wherein said chambers comprise generally linear channels arrayed generally parallel to said long peripheral edges, said resonator panel being mounted to said supporting frame at about said four corners and at least at one other location on one said short peripheral edge, said one other location being spaced from a mid-point of one said short peripheral edge.

7. A flat speaker of claim 1 wherein said chambers comprise generally linear channels arrayed generally parallel to said long peripheral edges, said resonator panel being mounted to said supporting frame at about said four corners and at least at two other locations on said short peripheral edges, said short peripheral edges having mid-points, said two other locations being spaced from said mid-points.

8. A flat speaker of claim 1 wherein said resonator has a total volume and a void volume, the ratio of said void volume to said total volume being from about 0.95–0.6 to 1.

* * * * *